US006152091A

United States Patent [19]

Bailey et al.

[11] Patent Number: 6,152,091

[45] Date of Patent: Nov. 28, 2000

[54] METHOD OF OPERATING A FREE PISTON INTERNAL COMBUSTION ENGINE WITH A VARIABLE PRESSURE HYDRAULIC FLUID OUTPUT

[75] Inventors: Brett M. Bailey; Willibald G. Berlinger, both of Peoria, Ill.

[73] Assignee: Caterpillar Inc., Peoria, Ill.

[21] Appl. No.: 09/255,282

[22] Filed: Feb. 22, 1999

[51] Int. Cl.[7] ..... F02B 71/00

[52] U.S. Cl. ..... 123/46 R

[58] Field of Search ..... 123/46 R, 46 B, 123/46 E

[56] References Cited

U.S. PATENT DOCUMENTS

| | | | |
|---|---|---|---|
| 2,960,818 | 11/1960 | Horgen | 123/46 R |
| 3,194,007 | 7/1965 | Bouvier et al. | 123/46 R |
| 3,386,647 | 6/1968 | Sorensen et al. | 123/46 R |
| 3,606,591 | 9/1971 | Potma . | |
| 3,722,481 | 3/1973 | Braun | 123/46 R |
| 3,853,100 | 12/1974 | Braun | 123/46 R |
| 4,599,861 | 7/1986 | Beaumont . | |
| 4,737,078 | 4/1988 | Dantlgraber . | |
| 4,992,031 | 2/1991 | Sampo . | |
| 5,341,311 | 8/1994 | Liebler . | |
| 5,775,273 | 7/1998 | Beale . | |

FOREIGN PATENT DOCUMENTS

| | | | |
|---|---|---|---|
| 0254353A1 | 7/1987 | European Pat. Off. | F02B 71/04 |
| 0 481 690 A2 | 4/1992 | European Pat. Off. . | |
| 0280200B1 | 5/1992 | European Pat. Off. | F02B 71/04 |
| 93/10342 | 5/1993 | WIPO | F02B 71/04 |
| 93/10343 | 5/1993 | WIPO | F02B 71/04 |
| 93/10345 | 5/1993 | WIPO | F02B 71/04 |
| WO 93/10345 | 5/1993 | WIPO . | |
| 96/3576A1 | 2/1996 | WIPO . | |
| 96/32576 | 10/1996 | WIPO . | |
| WO 98/54450 | 12/1998 | WIPO . | |

OTHER PUBLICATIONS

TU Dresden—publication date unknown—earliest date 1993, Dresden University in Germany.

*Primary Examiner*—Marguerite McMahon
*Attorney, Agent, or Firm*—Todd T. Taylor

[57] ABSTRACT

A method of operating a free piston engine with a housing including a combustion cylinder and a second cylinder. A piston includes a piston head reciprocally disposed within the combustion cylinder, a second head reciprocally disposed within the second cylinder, and a plunger rod interconnecting the piston head with the second head. The second head and the second cylinder define a variable volume pressure chamber on a side of the second head generally opposite the interconnecting plunger rod. The piston is moved between a bottom dead center position and a top dead center position during a compression stroke. A fuel and air mixture is combusted in the combustion cylinder when the piston is at or near the top dead center position. The piston is moved between the top dead center position and the bottom dead center position during a return stroke. A hydraulic accumulator is coupled with the pressure chamber during the return stroke. A pressure output from the pressure chamber to the hydraulic accumulator is varied during the return stroke, dependent upon when the hydraulic accumulator is coupled with the pressure chamber during the return stroke.

6 Claims, 3 Drawing Sheets

METHOD OF OPERATING A FREE PISTON INTERNAL COMBUSTION ENGINE WITH A VARIABLE PRESSURE HYDRAULIC FLUID OUTPUT

TECHNICAL FIELD

The present invention relates to free piston internal combustion engines, and, more particularly, to a method of operating a free piston internal combustion engine with a hydraulic power output.

BACKGROUND ART

Internal combustion engines typically include a plurality of pistons which are disposed within a plurality of corresponding combustion cylinders. Each of the pistons is pivotally connected to one end of a piston rod, which in turn is pivotally connected at the other end thereof with a common crankshaft. The relative axial displacement of each piston between a top dead center (TDC) position and a bottom dead center (BDC) position is determined by the angular orientation of the crank arm on the crankshaft with which each piston is connected.

A free piston internal combustion engine likewise includes a plurality of pistons which are reciprocally disposed in a plurality of corresponding combustion cylinders. However, the pistons are not interconnected with each other through the use of a crankshaft. Rather, each piston is typically rigidly connected with a plunger rod which is used to provide some type of work output. In a free piston engine with a hydraulic output, the plunger is used to pump hydraulic fluid which can be used for a particular application. Typically, the housing which defines the combustion cylinder also defines a hydraulic cylinder in which the plunger is disposed and an intermediate compression cylinder between the combustion cylinder and the hydraulic cylinder. The combustion cylinder has the largest inside diameter; the compression cylinder has an inside diameter which is smaller than the combustion cylinder; and the hydraulic cylinder has an inside diameter which is still yet smaller than the compression cylinder. A compression head which is attached to and carried by the plunger at a location between the piston head and plunger head has an outside diameter which is just slightly smaller than the inside diameter of the compression cylinder. A high pressure hydraulic accumulator which is fluidly connected with the hydraulic cylinder is pressurized through the reciprocating movement of the plunger during operation of the free piston engine. An additional hydraulic accumulator is selectively interconnected with the area in the compression cylinder to exert a relatively high axial pressure against the compression head and thereby move the piston head toward the TDC position.

With a free piston engine as described above, a check valve interconnects a variable volume pressure chamber within the hydraulic cylinder with a high pressure hydraulic accumulator. As the piston passes the TDC position and begins toward the BDC position during a return stroke, the check valve is biased to an open position by the increasing pressure which is created within the pressure chamber of the hydraulic cylinder. The maximum pressure which can be created within the high pressure hydraulic accumulator is equal to the maximum pressure which is developed within the hydraulic cylinder. Since the check valve opens at or near the TDC position, the maximum pressure which is developed within the hydraulic cylinder corresponds to the pressure developed during a full stroke of the piston traveling from the TDC to is the BDC position.

Under certain operating conditions, it may be desirable to provide the free piston engine with a pressure output which is higher than normally attained. For example, certain operating conditions may require a high pressure but low flow supply of hydraulic fluid from the free piston engine. An example of such an operating condition would be when a front end payloader is digging into a mound of dirt and the hydrostatic drive within the payloader requires more pressure than is typically available from the free piston engine.

The present invention is directed to overcoming one or more of the problems as set forth above.

SUMMARY OF THE INVENTION

The present invention provides a method of operating a free piston engine in which the output pressure of the hydraulic cylinder may be increased over a normal maximum output pressure by decreasing the effective stroke length of the plunger during a return stroke.

In one aspect of the method of operating a free piston engine of the present invention, a housing includes a combustion cylinder and a second cylinder. A piston includes a piston head reciprocally disposed within the combustion cylinder, a second head reciprocally disposed within the second cylinder, and a plunger rod interconnecting the piston head with the second head. The second head and the second cylinder define a variable volume pressure chamber on a side of the second head generally opposite the interconnecting plunger rod. The piston is moved between a BDC position and a TDC position during a compression stroke. A fuel and air mixture is combusted in the combustion cylinder when the piston is at or near the TDC position. The piston is moved between the TDC position and the BDC position during a return stroke. A hydraulic accumulator is coupled with the pressure chamber during the return stroke. A pressure output from the pressure chamber to the hydraulic accumulator is varied during the return stroke, dependent upon when the hydraulic accumulator is coupled with the pressure chamber during the return stroke.

An advantage of the present invention is that the normal maximum output pressure from the hydraulic cylinder to the high pressure hydraulic accumulator can be increased when required by operating conditions.

Another advantage is that the normal maximum output pressure from the hydraulic cylinder associated with a full stroke length can be increased without additional mechanisms, pumps, etc.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
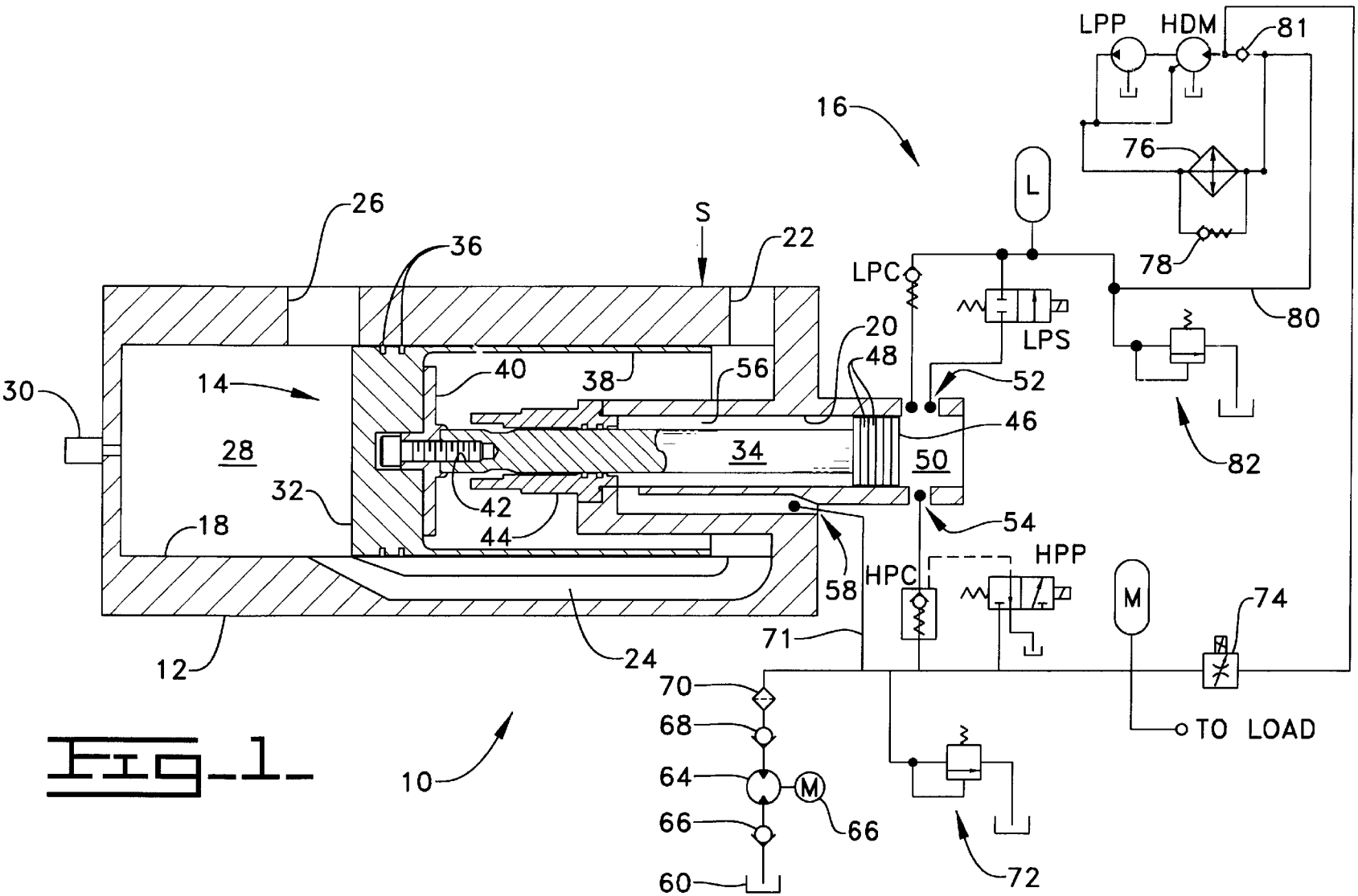
FIG. 1 is a schematic illustration of an embodiment of a free piston engine with which an embodiment of a method of the present invention may be used.

Referring now to the drawings, and more particularly to FIG. 1, there is shown an embodiment of a free piston internal combustion engine 10 which may be used with an embodiment of the method of the present invention, and which generally includes a housing 12, piston 14, and hydraulic circuit 16.

Housing 12 includes a combustion cylinder 18 and a hydraulic cylinder 20. Housing 12 also includes a combustion air inlet 22, air scavenging channel 24 and exhaust outlet 26 which are disposed in communication with a combustion chamber 28 within combustion cylinder 18. Combustion air is transported through combustion air inlet 22 and air scavenging channel 24 into combustion chamber 28 when piston 14 is at or near a BDC position. An appropriate fuel, such as a selected grade of diesel fuel, is injected into combustion chamber 28 as piston 14 moves toward a TDC position using a controllable fuel injector system, shown schematically and referenced as 30. The stroke length of piston 14 between a BDC position and a TDC position may be fixed or variable.

Piston 14 is reciprocally disposed within combustion cylinder 18 and is moveable during a compression stroke toward a TDC position and during a return stroke toward a BDC position. Piston 14 generally includes a piston head 32 which is attached to a plunger rod 34. Piston head 32 is formed from a metallic material in the embodiment shown, such as aluminum or steel, but may be formed from another material having suitable physical properties such as coefficient of friction, coefficient of thermal expansion and temperature resistance. For example, piston head 32 may be formed from a non-metallic material such as a composite or ceramic material. More particularly, piston head 32 may be formed from a carbon-carbon composite material with carbon reinforcing fibers which are randomly oriented or oriented in one or more directions within the carbon and resin matrix.

Piston head 32 includes two annular piston ring groves 36 in which are disposed a pair of corresponding piston rings (not numbered) to prevent blow-by of combustion products on the return stroke of piston 14 during operation. If piston head 32 is formed from a suitable non-metallic material having a relatively low coefficient of thermal expansion, it is possible that the radial operating clearance between piston head 32 and the inside surface of combustion cylinder 18 may be reduced such that piston ring grooves 36 and the associated piston rings may not be required. Piston head 32 also includes an elongated skirt 38 which lies adjacent to and covers exhaust outlet 26 when piston 14 is at or near a TDC position, thereby preventing combustion air which enters through combustion air inlet 22 from exiting out exhaust outlet 26.

Plunger rod 34 is rigidly attached to piston head 32 at one end thereof using a mounting hub 40 and a bolt 42. Bolt 42 extends through a hole (not numbered) in mounting hub 40 and is threadingly engaged with a corresponding hole formed in the end of plunger rod 34. Mounting hub 40 is then attached to the side of piston head 32 opposite combustion chamber 28 in a suitable manner, such as by using bolts, welding, and/or adhesive, etc. A seal 44 surrounding plunger rod 34 and carried by housing 12 separates combustion cylinder 18 from hydraulic cylinder 20.

Plunger head 46 is rigidly attached to an end of plunger rod 34 opposite from piston head 32. Reciprocating movement of piston head 32 between a BDC position and a TDC position, and vice versa, causes corresponding reciprocating motion of plunger rod 34 and plunger head 46 within hydraulic cylinder 20. Plunger head 46 includes a plurality of sequentially adjacent lands and valleys 48 which effectively seal with and reduce friction between plunger head 46 and an inside surface of hydraulic cylinder 20.

Plunger head 46 and hydraulic cylinder 20 define a variable volume pressure chamber 50 on a side of plunger head 46 generally opposite from plunger rod 34. The volume of pressure chamber 50 varies depending upon the longitudinal position of plunger head 46 within hydraulic cylinder 20. A fluid port 52 and a fluid port 54 are fluidly connected with variable volume pressure chamber 50. An annular space 56 surrounding plunger rod 34 is disposed in fluid communication with a fluid port 58 in housing 12. Fluid is drawn through fluid port 58 into annular space 56 upon movement of plunger rod 34 and plunger head 46 toward a BDC position so that a negative pressure is not created on the side of plunger head 46 opposite variable volume pressure chamber 50. The effective cross-sectional area of pressurized fluid acting on plunger head 46 within variable volume pressure chamber 50 compared with the effective cross-sectional area of pressured fluid acting on plunger head 46 within annular space 56, is a ratio of between approximately 5:1 to 30:1. In the embodiment shown, the ratio between effective cross-sectional areas acting on opposite sides of plunger head 46 is approximately 20:1. This ratio has been found suitable to prevent the development of a negative pressure within annular space 56 upon movement of plunger head 46 toward a BDC position, while at the same time not substantially adversely affecting the efficiency of free piston engine 10 while plunger head 46 is traveling toward a TDC position.

Hydraulic circuit 16 is connected with hydraulic cylinder 20 and provides a source of pressurized fluid, such as hydraulic fluid, to a load for a specific application, such as a hydrostatic drive unit (not shown). Hydraulic circuit 16 generally includes a high pressure hydraulic accumulator (H), a low pressure hydraulic accumulator (L), and suitable valving, etc. used to connect high pressure hydraulic accumulator H and low pressure hydraulic accumulator L with hydraulic cylinder 20 at selected points in time as will be described in greater detail hereinafter.

More particularly, hydraulic circuit 16 receives hydraulic fluid from a source 60 to initially charge high pressure hydraulic accumulator H to a desired pressure. A starter motor 62 drives a fluid pump 64 to pressurize the hydraulic fluid in high pressure hydraulic accumulator H. The hydraulic fluid transported by pump 64 flows through a check valve 66 on an input side of pump 64, and a check valve 68 and filter 70 on an output side of pump 64. The pressure developed by pump 64 also pressurizes annular space 56 via the interconnection with line 71 and fluid port 58. A pressure relief valve 72 ensures that the pressure within high pressure hydraulic accumulator H does not exceed a threshold limit.

The high pressure hydraulic fluid which is stored within high pressure hydraulic accumulator H is supplied to a load suitable for a specific application, such as a hydrostatic drive unit. The high pressure within high pressure hydraulic accumulator H is initially developed using pump 64, and is thereafter developed and maintained using the pumping action of free piston engine 10.

A proportional valve 74 has an input disposed in communication with high pressure hydraulic accumulator H, and provides the dual functionality of charging low pressure hydraulic accumulator L and providing a source of fluid power for driving ancillary mechanical equipment on free piston engine 10. More particularly, proportional valve 74 provides a variably controlled flow rate of high pressure hydraulic fluid from high pressure hydraulic accumulator H to a hydraulic motor HDM. Hydraulic motor HDM has a rotating mechanical output shaft which drives ancillary equipment on free piston engine 10 using a belt and pulley arrangement, such as a cooling fan, alternator and water pump. Of course, the ancillary equipment driven by hydraulic motor HDM may vary from one application to another.

Hydraulic motor HDM also drives a low pressure pump LPP which is used to charge low pressure hydraulic accumulator L to a desired pressure. Low pressure pump LPP has a fluid output which is connected in parallel with each of a heat exchanger 76 and a check valve 78. If the flow rate through heat exchanger 76 is not sufficient to provide an adequate flow for a required demand, the pressure differential on opposite sides of check valve 78 causes check valve 78 to open, thereby allowing hydraulic fluid to by-pass heat exchanger 76 temporarily. If the pressure developed by low pressure pump LPP which is present in line 80 exceeds a threshold value, check valve 81 opens to allow hydraulic fluid to bleed back to the input side of hydraulic motor HDM. A pressure relief valve 82 prevents the hydraulic fluid within line 80 from exceeding a threshold value.

Low pressure hydraulic accumulator L selectively provides a relatively lower pressure is hydraulic fluid to pressure chamber 50 within hydraulic cylinder 20 using a low pressure check valve LPC and a low pressure shutoff valve LPS. Conversely, high pressure hydraulic accumulator H provides a higher pressure hydraulic fluid to pressure chamber 50 within hydraulic cylinder 20 using a high pressure check valve HPC and a high pressure pilot valve HPP.

During an initial start-up phase of free piston engine 10, starter motor 62 is energized to drive pump 64 and thereby pressurize high pressure hydraulic accumulator H to a desired pressure. Since piston 14 may not be at a position which is near enough to the BDC position to allow effective compression during a compression stroke, it may be necessary to effect a manual return procedure of piston 14 to a BDC position. To wit, low pressure shutoff valve LPS is opened using a suitable controller to minimize the pressure on the side of hydraulic plunger 46 which is adjacent to pressure chamber 50. Since annular space 56 is in communication with high pressure hydraulic accumulator H, the pressure differential on opposite sides of hydraulic plunger 46 causes piston 14 to move toward the BDC position, as shown in FIG. 1.

When piston 14 is at a position providing an effective compression ratio within combustion chamber 28, high pressure pilot valve HPP is actuated using a controller to manually open high pressure check valve HPC, thereby providing a pulse of high pressure hydraulic fluid from high pressure hydraulic accumulator into pressure chamber 50. Low pressure check valve LPC and low pressure shutoff valve LPS are both closed when the pulse of high pressure hydraulic fluid is provided to pressure chamber 50. The high pressure pulse of hydraulic fluid causes plunger head 46 and piston head 32 to move toward the TDC position. Because of the relatively large ratio difference in cross-sectional areas on opposite sides of plunger head 46, the high pressure hydraulic fluid which is present within annual space 56 does not adversely interfere with the travel of plunger head 46 and piston head 32 toward the TDC position. The pulse of high pressure hydraulic fluid is applied to pressure chamber 50 for a period of time which is sufficient to cause piston 14 to travel with a kinetic energy which will effect combustion within combustion chamber 28. The pulse may be based upon a time duration or a sensed position of piston head 32 within combustion cylinder 18.

As plunger head 46 travels toward the TDC position, the volume of pressure chamber 50 increases. The increased volume in turn results in a decrease in the pressure within pressure chamber 50 which causes high pressure check valve HPC to close and low pressure check valve LPC to open. The relatively lower pressure hydraulic fluid which is in low pressure hydraulic accumulator L thus fills the volume within pressure chamber 50 as plunger head 46 travels toward the TDC position. By using only a pulse of pressure from high pressure hydraulic accumulator H during a beginning portion of the compression stroke (e.g., during 60% of the stroke length), followed by a fill of pressure chamber 50 with a lower pressure hydraulic fluid from low pressure hydraulic accumulator L, a net resultant gain in pressure within high pressure hydraulic accumulator H is achieved.

By properly loading combustion air and fuel into combustion chamber 28 through air scavenging channel 24 and fuel injector 30, respectively, proper combustion occurs within combustion chamber 28 at or near a TDC position. As piston 14 travels toward a BDC position after combustion, the volume decreases and pressure increases within pressure 50. The increasing pressure causes low pressure check valve LPC to close and high pressure check valve HPC to open. The high pressure hydraulic fluid which is forced through high pressure check valve during the return stroke is in communication with high pressure hydraulic accumulator H, resulting in a net positive gain in pressure within high pressure hydraulic accumulator H.

Figure 2:
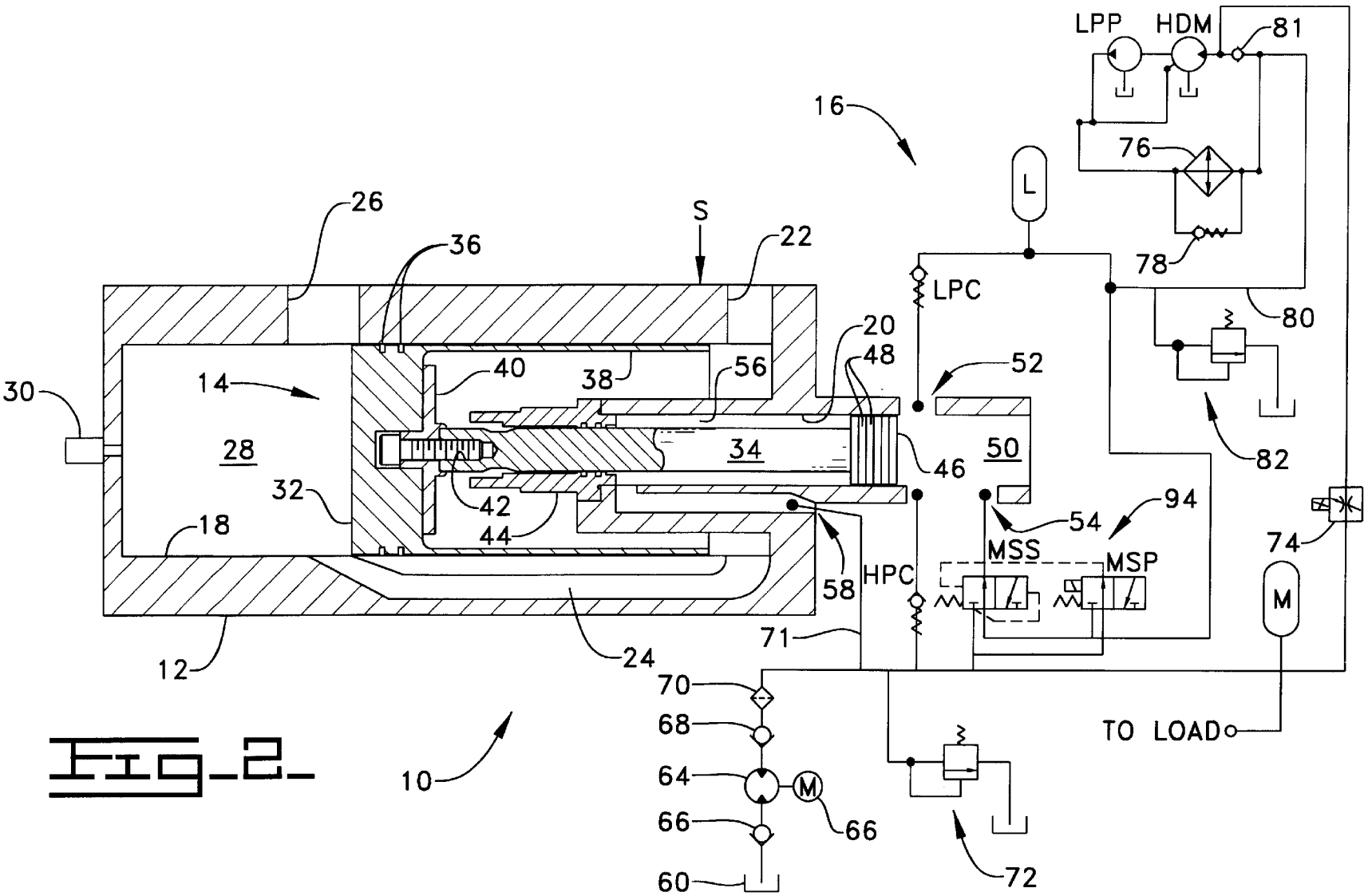
FIG. 2 is a schematic illustration of another embodiment of a free piston engine with which another embodiment of a method of the present invention may be used.

FIG. 2 illustrates another embodiment of a free piston internal combustion engine 90 which may be used with an embodiment of the method of the present invention, and which includes a combustion cylinder and piston arrangement which is substantially the same as the embodiment shown in FIG. 1. Hydraulic circuit is 92 of free piston engine 90 also includes many hydraulic components which are the same as the embodiment of hydraulic circuit 16 shown in FIG. 1. Hydraulic circuit 92 principally differs from hydraulic circuit 16 in that hydraulic circuit 92 includes a mini-servo valve 94 with a mini-servo main spool MSS and a mini-servo pilot MSP. Mini-servo main spool MSS is controllably actuated at selected points in time during operation of free piston engine 90 to effect the high pressure pulse of high pressure hydraulic fluid from high pressure hydraulic accumulator H, similar to the manner described above with regard to the embodiment shown in FIG. 1. Mini-servo pilot MSP is controllably actuated to provide the pressure necessary for controllably actuating mini-servo main spool MSS. The pulse of high pressure hydraulic fluid is provided to pressure chamber 50 for a duration which is either dependent upon time or a sensed position of piston 14. As the volume within pressure chamber 50 increases, the pressure correspondingly decreases, resulting in an opening of low pressure check valve LPC. Low pressure hydraulic fluid from low pressure hydraulic accumulator L thus flows into pressure chamber 50 during the compression stroke of piston 14. After combustion and during the return stroke of piston 14, the pressure within pressure chamber 50 increases, thereby causing low pressure check valve LPC to close and high pressure check valve HPC to open. The high pressure hydraulic fluid created within pressure chamber 50 during the return stroke of piston 14 is pumped through high pressure check valve HPC and into high pressure hydraulic accumulator H, thereby resulting in a net positive gain in the pressure within high pressure hydraulic accumulator H.

Figure 3:
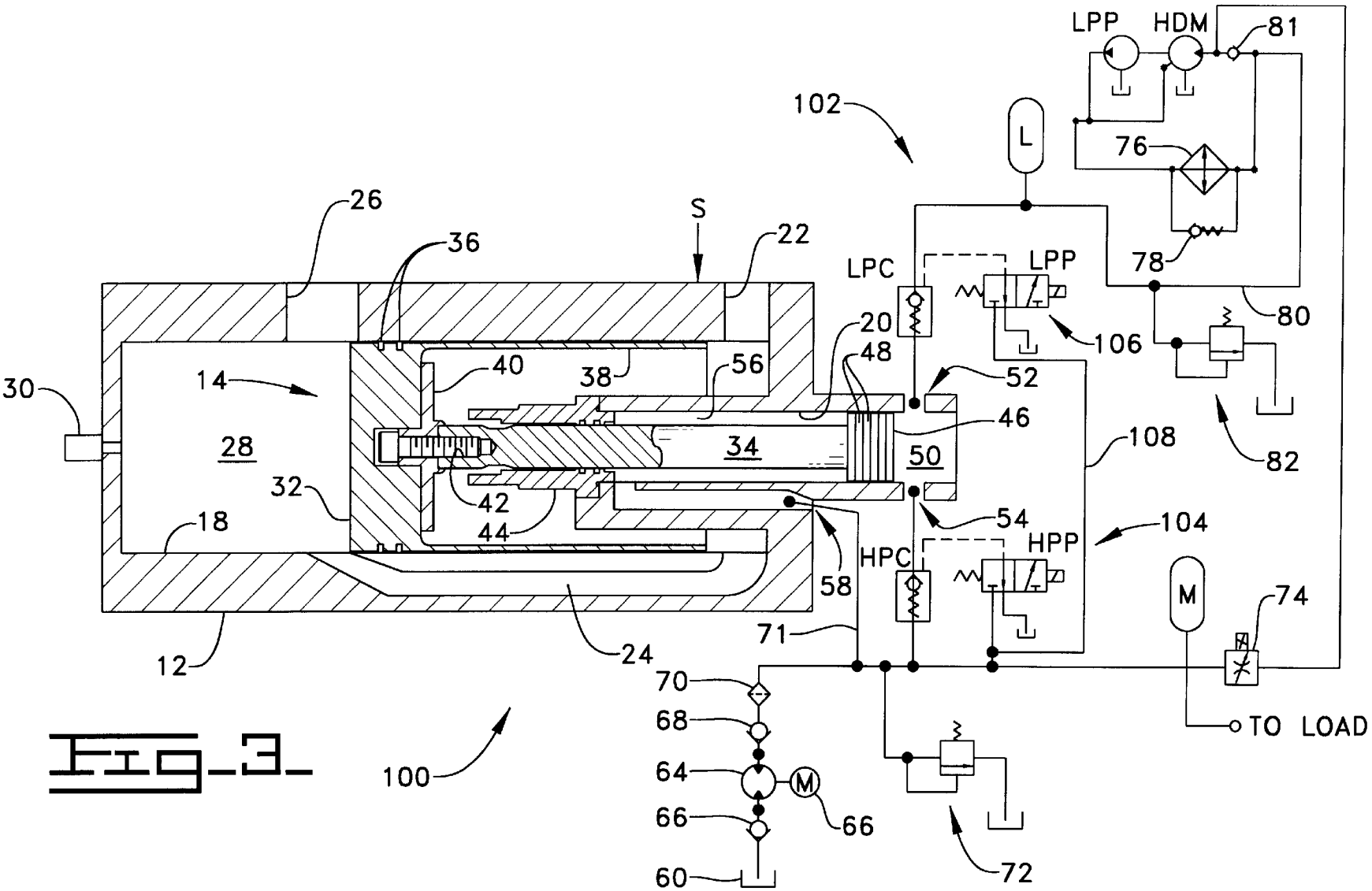
FIG. 3 is a schematic illustration of yet another embodiment of a free piston engine with which another embodiment of a method of the present invention may be used.

Referring now to FIG. 3, there is shown yet another embodiment of a free piston engine 100 with which the method of the present invention may be used. Again, the arrangement of combustion cylinder 18 and piston 14 is substantially the same as the embodiment of free piston engines 10 and 90 shown in FIGS. 1 and 2. Hydraulic circuit 102 also likewise includes many hydraulic components which are the same as the embodiments of hydraulic circuits 16 and 92 shown in FIGS. 1 and 2. However, hydraulic circuit 102 includes two pilot operated check valves 104 and 106. Pilot operated check valve 104 includes a high pressure check valve (HPC) and a high pressure pilot valve (HPP) which operate in a manner similar to high pressure check valve HPC and high pressure pilot valve HPP described above with reference to the embodiment shown in FIG. 1. Pilot operated check valve 106 includes a low pressure check valve (LPC) and a low pressure pilot valve (LPP) which also work in a manner similar to high pressure check valve 104. The input side of low pressure pilot valve LPP is connected with the high pressure fluid within high pressure hydraulic accumulator H through line 108. Low pressure pilot valve LPP may be controllably actuated using a controller to provide a pulse of pressurized fluid to low pressure check valve LPC which is sufficient to open low pressure check valve LPC.

During use, a pulse of high pressure hydraulic fluid may be provided to pressure chamber 50 using pilot operated check valve 104 to cause piston 14 to travel toward a TDC position with enough kinetic energy to effect combustion. High pressure pilot valve HPP is deactuated, dependent upon a period of time or a sensed position of piston 14, to thereby allow high pressure check valve HPC to close. As plunger head 46 moves toward the TDC position, the pressure within pressure chamber 50 decreases and low pressure check valve LPC is opened. Low pressure hydraulic fluid thus fills the volume within pressure chamber 50 while the volume within pressure chamber 50 expands. After combustion, piston 14 moves toward a BDC position which causes the pressure within pressure chamber 50 to increase. The increase causes low pressure check valve LPC to close and high pressure check valve to open. The high pressure hydraulic fluid which is generated by the pumping action of plunger head 46 within hydraulic cylinder 20 flows into high pressure hydraulic accumulator H, resulting in a net positive gain in the pressure within high pressure hydraulic accumulator H. A sensor (schematically illustrated and positioned at S) detects piston 14 near a BDC position. The high pressure pulse to effect the compression stroke can be timed dependent upon the sensor activation signal.

To effect a manual return procedure using the embodiment of free piston engine 100 shown in FIG. 3, high pressure hydraulic fluid is provided into annular space 56 from high pressure hydraulic accumulator H. Low pressure pilot valve LPP is controllably actuated to cause low pressure check valve LPC to open. The pressure differential on opposite sides of plunger head 46 causes piston 14 to move toward a BDC position. When piston 14 is at a position providing an effective compression ratio to effect combustion within combustion chamber 28, a high pressure pulse of hydraulic fluid is transported into pressure chamber 50 using pilot operated check valve 104 to begin the compression stroke of piston 14.

During normal operation of free piston engines 10, 90 and 100 described above, pressure chamber 50 is coupled with high pressure accumulator H just slightly after piston 14 travels past a TDC position and begins the return stroke. Thus, pressurized hydraulic fluid which is generated in pressure chamber 50 as piston 14 moves to the BDC position is pumped into high pressure hydraulic accumulator H at a maximum pressure corresponding to the full stroke length of piston 14 between the TDC position and the BDC position. However, certain operating conditions may require that free piston engines 10, 90 or 100 provide a source of pressurized hydraulic fluid which is at a higher pressure than normally occurs.

According to the method of the present invention, the point in time during the return stroke at which high pressure hydraulic accumulator H is coupled with pressure chamber 50 is delayed so that the normal maximum operating pressure provided from pressure chamber 50 may be increased when required for certain operating conditions. The embodiment of the method of the present invention which will now be described in greater detail is assumed to be carried out using free piston engine 10 shown in FIG. 1. However, the method of the present invention may also be carried out using other embodiments of a free piston engine, such as free piston engine 100 shown in FIG. 3. The method of the present invention may also be used with the embodiment of free piston engine 90 shown in FIG. 2 if the valve connecting low pressure accumulator L with pressure chamber 50 is modified to be a controllable valve.

From a conservation of energy standpoint, the work output which may be provided by plunger head 46 within hydraulic cylinder 20 cannot exceed the amount of energy which is input within combustion chamber 28 during the combustion of the fuel and air mixture. Thus, for a conservation of energy, the following relationships apply to the operation of free piston engine 10:

Energy input=Energy output where,

Energy input=combustion energy, and

Energy output=output to hydraulic circuit.

The energy input can be modified by changing the amount of fuel which is injected into combustion chamber 28, or by changing the fuel and air mixture to affect the combustion efficiency. The energy output from the pumping action of hydraulic circuit 16 is represented by the mathematical expression:

$$\text{Energy output}=P*V$$
$$=P*(S*A)$$

where,

P=pressure,

V=volume,

S=stroke length, and

A=area of hydraulic cylinder.

Thus, combining the above equations yields:

$$\text{Energy input}=P*(S*A)$$

Therefore, the output pressure from hydraulic circuit 16 is represented by:

$$P=\text{Energy input}/S*A$$

It is apparent from the above mathematical equation that the output pressure from pressure chamber 50 may be varied by varying the input energy into combustion chamber 28, the stroke length of piston 14 or the cross sectional area within hydraulic cylinder 20. Since the cross sectional area of plunger head 46 is fixed after manufacture, the pressure output from pressure chamber 50 can effectively only be changed by changing the energy input into combustion chamber 28 or the stroke length of piston 14.

From an efficiency standpoint, it may not be desirable to change the fuel and air mixture which is loaded into combustion chamber 28 during each cycle of piston 14. The most efficient operation of free piston engine 10 occurs when a maximum amount of fuel is loaded into combustion chamber 28 and combined with a corresponding load of combustion air. Moreover, specific operating conditions may require an even higher pressure than is already being provided when the maximum amount of fuel is loaded into combustion chamber 28. Thus, varying the amount of fuel may not be desirable from an efficiency standpoint, and may not be possible if a maximum amount of fuel is already being loaded into combustion chamber 28.

On the other hand, it is also apparent from the above equation that the output pressure from pressure chamber 50 may be increased by decreasing the stroke length S of piston 14.

According to the method of the present invention, pressure chamber 50 is not coupled with high pressure hydraulic accumulator H at the beginning portion of the return stroke of piston 14 just after piston 14 passes the TDC position. Rather, the point in time at which pressure chamber 50 is coupled with high pressure hydraulic accumulator H is delayed during the return stroke so that the effective stroke length of piston 14 is decreased. That is, the same amount of energy which is input into free piston engine 10 during the combustion process within combustion chamber 28 must be absorbed within a shorter effective stroke length of piston 14 during the return stroke, thereby resulting in a higher output pressure from pressure chamber 50.

After the pulse of high pressure hydraulic fluid is supplied to pressure chamber 50 during the beginning portion of the compression stroke, high pressure hydraulic accumulator H is decoupled from pressure chamber 50 and low pressure hydraulic accumulator L is coupled with pressure chamber 50 to fill the expanding volume within pressure chamber 50 with lower pressure hydraulic fluid. As piston 14 travels past the TDC position and begins the return stroke, high pressure check valve would normally open because of the increasing pressure within pressure chamber 50. However, with the method of the present invention, low pressure shutoff valve LPS is actuated at a point in time while low pressure check valve LPC is still open. Thus, when piston 14 begins the return stroke, hydraulic fluid within pressure chamber 50 is merely wasted through low pressure shutoff valve LPS to low pressure hydraulic accumulator L. At a selected point in time during the return stroke of piston 14, low pressure hydraulic accumulator L is decoupled from pressure chamber 50 and high pressure hydraulic accumulator H is coupled with pressure chamber 50. Waiting until a later point in time during the return stroke effectively reduces the stroke length of piston 14 and causes a higher pressure hydraulic fluid to be pumped into high pressure hydraulic accumulator H. The amount of time corresponding to the delay relative to the normal stroke length of piston 14 is proportional to the increase in pressure in the hydraulic fluid which is pumped from pressure chamber 50. Thus, if the delay time corresponds to 40% of the return stroke, the output pressure will be 40% higher than would normally occur during the full stroke of piston 14. Varying the delay time during the return stroke therefore allows the output pressure to be varied over the normal maximum output pressure associated with the full stroke.

INDUSTRIAL APPLICABILITY

During use, piston 14 is reciprocally disposed within combustion cylinder 16. Piston 14 travels between a BDC position and a TDC position during a compression stroke and between a TDC position and a BDC position during a return stroke. Combustion air is introduced into combustion chamber 28 through combustion air inlet 22 and air scavenging channel 24. Fuel is controllably injected into combustion chamber 28 using a fuel injector 30. During normal operation, high pressure hydraulic accumulator H is coupled with pressure chamber 50 shortly after piston 14 passes the TDC position and begins a return stroke. The output pressure of the hydraulic fluid which is pumped from pressure chamber 50 therefore corresponds to the full stroke length of piston 14 between the TDC and BDC position. If the load to which free piston engine 10 is attached requires a higher output pressure than is normally available, the high pressure hydraulic accumulator H may be coupled with pressure chamber 50 at a point in time between the TDC position and the BDC position during the return stroke which allows the output pressure to be increased. A longer delay in coupling high pressure hydraulic accumulator H with pressure chamber 50 during the return stroke causes a proportionate increase in the output pressure from pressure chamber 50.

The present invention allows the normal maximum output pressure from the hydraulic cylinder to the high pressure hydraulic accumulator to be increased when required by operating conditions. The normal maximum output pressure from the hydraulic cylinder associated with a full stroke length can be increased without additional mechanisms, pumps, etc.

Other aspects, objects and advantages of this invention can be obtained from a study of the drawings, the disclosure and the appended claims.

What is claimed is:

1. A method of operating a free piston internal combustion engine, comprising the steps of:

providing a housing including a combustion cylinder and a second cylinder;

providing a piston including a piston head reciprocally disposed within said combustion cylinder, a second head reciprocally disposed within said second cylinder, and a plunger rod interconnecting said piston head with said second head, said second head and said second cylinder defining a variable volume pressure chamber on a side of said second head generally opposite said interconnecting plunger rod;

moving said piston between a bottom dead center position and a top dead center position during a compression stroke;

combusting a fuel and air mixture in said combustion cylinder when said piston is one of at and near said top dead center position;

moving said piston between said top dead center position and said bottom dead center position during a return stroke;

selecting an output operating pressure from said pressure chamber; and coupling a hydraulic accumulator with said pressure chamber at a selected point in time during said return stroke to thereby attain said output operating pressure.

2. The method of claim 1, wherein said varying step comprises varying said pressure output from said pressure chamber to said hydraulic accumulator by delaying a point in time at which said hydraulic accumulator is coupled with said pressure chamber during said return stroke.

3. The method of claim 2, wherein a longer delay in coupling said hydraulic accumulator with said pressure chamber during said return stroke results in an increased pressure output.

4. The method of claim 1, wherein said return stroke has a full stroke length, said piston traveling a given percentage of said full stroke length while said hydraulic accumulator is coupled with said pressure chamber, said maximum operating pressure of said pressure output being indirectly proportional to said given percentage of said full stroke length.

5. The method of claim 1, wherein said hydraulic accumulator comprises a high pressure hydraulic accumulator.

6. The method of claim 1, wherein said second cylinder comprises a hydraulic cylinder and said second head comprises a plunger head.

* * * * *